United States Patent [19]

Kupec

[11] 3,947,036

[45] Mar. 30, 1976

[54] WORD GAME APPARATUS

[76] Inventor: Emil J. Kupec, 2113 S. Lombard, Cicero, Ill. 60650

[22] Filed: June 28, 1973

[21] Appl. No.: 374,631

[52] U.S. Cl. ..... 273/130 E; 35/75; 273/136 G; 273/136 W

[51] Int. Cl.[2] ..... A63F 3/00

[58] Field of Search..... 273/130 E, 131 G, 134 AB, 273/135 D, 136 G, 136 F, 136 W, 142 HA, 143 R, 155; 35/31 E, 75, 31 B, 35 R, 35 F, 35 G, 35 H, 76; 40/65

[56] References Cited

UNITED STATES PATENTS

| | | | |
|---|---|---|---|
| 466,296 | 12/1891 | Clark | 273/130 E |
| 1,286,157 | 11/1918 | Vizcarra | 273/130 E X |
| 1,291,045 | 1/1919 | McCluer | 35/76 |
| 1,833,793 | 11/1931 | Pfleger | 273/130 E |
| 2,349,070 | 5/1944 | Axelrod | 40/65 |
| 2,477,134 | 7/1949 | Mariner | 35/75 X |
| 2,668,371 | 2/1954 | Artmann | 35/75 X |
| 2,722,425 | 1/1955 | Gazelle | 273/136 G X |
| 2,771,076 | 11/1956 | Peter | 40/359 X |
| 2,974,433 | 3/1961 | Litzinger | 273/130 E |
| 3,200,517 | 8/1965 | D'Agostino | 35/74 X |
| 3,734,506 | 5/1973 | Gingrass | 273/130 E |

FOREIGN PATENTS OR APPLICATIONS

| | | |
|---|---|---|
| 701,570 | 1/1965 | Canada |

*Primary Examiner*—Anton O. Oechsle
*Assistant Examiner*—Harry G. Strappello
*Attorney, Agent, or Firm*—Hofgren, Wegner, Allen, Stellman & McCord

[57] ABSTRACT

An apparatus for playing word games wherein a group of carriers are movably mounted on a base for selectively exposing different letters through a row of spaced openings defined by the base. The exposed letters are disposed in side-by-side relationship to comprise words. Each carrier is provided with indicia at the mid-portion of the set of letters thereof for indicating that the carrier is in an original non-manipulated position.

1 Claim, 6 Drawing Figures

WORD GAME APPARATUS

BACKGROUND OF THE INVENTION

1. Field of the Invention

This invention relates to games and in particular to apparatus for playing word games and the like.

2. Description of the Prior Art

In one known form of word-forming device a plurality of carrier strips are slidably mounted in a base element for selectively exposing letters carried on the strips through a series of openings in the base element. An example of such a Word Forming Device is shown in U.S. Pat. No. 2,848,824 issued to J. W. Donaldson for a Word Forming Device.

Another form of such a device is shown in U.S. Pat. No. 1,607,329 of D. R. Westlake entitled Educational Appliance.

Another example of such a display device is shown in D. P. Litzinger's U.S. Pat. No. 2,974,433 entitled "Changeable Indicia Display Device". In the Litzinger device, the carrier strips project outwardly through a number of slits in the front face of the device and they are allowed to slidably contact each other for a mutual guiding action. A pair of such slits extends continuously across a major portion of the front face so that the entire set of strips is exposed at the portion thereof disposed between the slits. The carrier strips are provided with an alphabetical set of letters, other letters, numerals, and symbols. Litzinger teaches that interspersed among the characters are a number of blanks appearing as black squares and discloses such blanks between the letters "M" and "O" of the alphabetical set. The sets of letters further vary in the different strips as to their relative relationship so that the different strips are positioned differently to present different letters or black squares between the slits.

Circular carriers are illustrated in U.S. Pat. Nos. 1,833,793 and 3,200,517 issued to L. A. Pfleger and A. D'Agostino, respectively. The Word Forming Device of A. D'Agostino further utilizes elongated strips which are slidable in guides to expose selected letters through spaced openings in the front face of the device which cooperate with the circular carrier to provide a lettered sequence.

Pfleger shown an educational device, utilizing a plurality of circular disks in overlapping relationship to expose a sequence of letters through an elongated opening.

SUMMARY OF THE INVENTION

The present invention comprehends an improved apparatus for playing word games including means for accurately centering the carriers for facilitated adjustment to any one of the alphabetically arranged letters. By providing a center indicium indicating that a given carrier has not been manipulated from the reset position, optimum efficiency in the use of the game is realized while yet permitting the game to be of minimum size.

More specifically, the invention comprehends providing such an apparatus for playing word games wherein a plurality of characters are slidably mounted on a base to be manually adjustably positioned for exposing any one of an alphabetical set of letters identically disposed on the different carriers to be exposed one letter at a time through the associated opening of a row of openings in the base. The invention comprehends providing on each carrier at the mid-portion of the set of letters an indicium indicating that the carrier has not as yet been manipulated in the playing of the game. The indicium may be provided as a blank space between the letters "M" and "N" in the alphabetical series.

The carriers may comprise elongated carriers and may be provided at one or both ends thereof with a selectively positionable manipulating portion for facilitated adjustment of the carrier in exposing the desired letter through the associated opening in the base. The manipulating means may comprise an element hingedly connected to the carrier so as to be positionable perpendicular thereto for use as a handle in manipulating the carrier, or to be extended parallel to the carrier to be received in one end of the slot in the base in which the carrier is slidably mounted.

The base may comprise a plurality of sections hingedly connected for folding thereof to a compacted storage position. The base may be provided with means for indicating a starting position opening at the center of the row of openings and where the base is foldable, the fold line may define the starting position indicating means.

Thus, the word game apparatus of the present invention is extremely simple and economical of construction while yet providing a number of highly desirable advantages over the structures of the prior art as discussed above.

BRIEF DESCRIPTION OF THE DRAWING

Other features and advantages of the invention will be apparent from the following description taken in connection with the accompanying drawing wherein.

DESCRIPTION OF THE PREFERRED EMBODIMENT

Figures 1, 2, 3, 4, 5, 6:
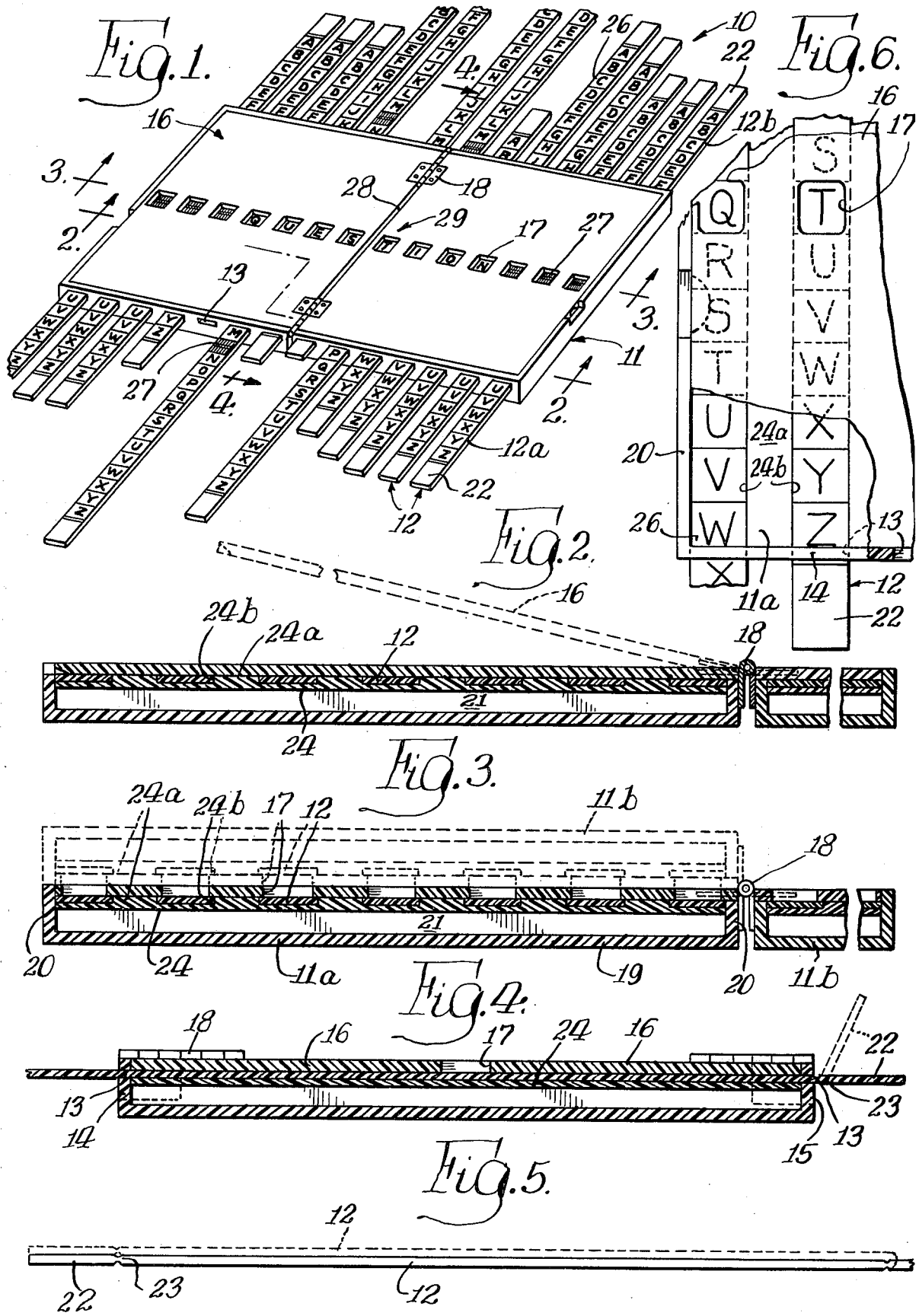
FIG. 1 is a perspective view of a word game playing apparatus embodying the invention.
FIG. 2 is a broken transverse vertical section taken substantially along the line 2—2 of FIG. 1.
FIG. 3 is a broken transverse vertical section taken substantially along the line 3—3 of FIG. 1.
FIG. 4 is a fragmentary, longitudinal vertical section taken substantially along the line 4—4 of FIG. 1.
FIG. 5 is a fragmentary, side elevation of a carrier strip shown in a folded disposition in dotted lines.
FIG. 6 is a fragmentary enlarged top plan view of a portion of the apparatus with portions broken away to facilitate illustration thereof.

In the exemplary embodiment of the invention as disclosed in the drawing, an apparatus generally designated 10 for playing word games is shown to include a base generally designated 11, and a plurality of carriers, herein strips, generally designated 12. The base defines means for guiding the carriers strips in parallel spaced relationship and in the illustrated embodiment the guiding means includes slots 13 in the front wall 14 and rear wall 15 respectively, of the base. As shown in FIG. 1, the carrier strips have a length greater than the space between walls 14 and 15 to have opposite ends 12a and 12b projecting outwardly therefrom.

The top wall 16 of the base is provided with a row of spaced openings 17 aligned with the paired slots 13 in the front and rear walls 14 and 15 so that one portion of each carrier strip is viewable through the respectively associated openings.

Base 11 may comprise a pair of hollow portions 11a and 11*b* which, as shown in FIG. 3, are hingedly connected by means of hinges 18 permitting the base portions 11*a* and 11*b* to be selectively disposed in a game-playing, opened position as shown in FIG. 1 and in FIG. 3 in full lines, or in a folded closed, storage position, as illustrated in FIG. 3 in broken lines. Each base portion includes a bottom wall 19 which cooperates with the side walls 20, front wall 14, rear wall 15, and top wall 16 to define a space 21 for receiving the carrier strips for storage. The top wall 16 may be swung on hinges 18 upwardly from space 21 as shown in broken lines in FIG. 3 to provide access to the space 21 when desired.

Each carrier strip defines opposite end portions 22 which may be utilized to manipulate the carrier strip for longitudinal positioning through the slots 13 to dispose different portions of the carrier strip in alignment with the corresponding opening 17 in base top wall 16. Illustratively, end portion 22 may comprise a tab having a hinge connection 23 permitting the tab to be swung perpendicularly to the flat-wise extent of the strip for facilitated manipulation of the strip. The strip is maintained closely underlying the top wall 16 by means of a retainer wall 24 having a plurality of guide portions 24*a* extending upwardly between the strips 12 to define a plurality of guide channels 24*b* aligned one each with each pair of slots 13. Thus, the carrier strips may be adjusted so as to move the end tab portions fully through the slots 13 to dispose the letters adjacent the ends 22 in alignment with the opening 17 as the end tabs 22 extend parallel to the flatwise extent of the strip for movement through the slots 13 therewith. The strips are guided by channels 24*b* back outwardly through the slots 13 in a reverse positioning of the strips 12.

Each of the strips is provided with an alphabetical set of letters 26 on the top surface thereof to be exposed one letter at a time through the associated opening 17. At the mid-portion of the set of letters, an indicum 27 is provided for indicating that the associated carrier has not as yet been manipulated to expose a selected letter through the opening in the playing of the game.

In the illustrated embodiment, the indicium 27 defines a blank space between the letters "M" and "N" in the alphabetical set so that when the blank space appears through the opening 17, the strip 12 is accurately centered longitudinally for minimum movement subsequently to the selected letter. Thus, the extension of the strips 12 outwardly from the opposite end walls 14 and 15 in the start position of the game is minimal while yet the strips may project sufficiently for facilitated manipulation.

When it is desired to store the game, the user may simply withdraw all of the strips from the base 11 and place them in the space 21 after raising the base portion top wall, as shown in FIG. 2, to expose the space 21. To provide a further compacted arrangement of the game in the storage disposition, the base may be folded about hinges 18 as shown in dotted lines in FIG. 3. The fold line between hinges 18 further defines a second indicium 28 for indicating the center openings of the row of openings 17. Thus, in playing the game the players may start by selecting a letter at a center opening so that letters may be added to the word in either direction therefrom. In the conventional playing of the game, the players successively add letters in sequence until one player either ends a word or is unable to continue in forming a word from the previous letters.

Thus, the game alternatively may be played by the players successively selecting letters starting at the lefthand row of openings 17 with each player selecting a letter to appear in the next opening to the right of the previous opening. If desired, a further indicium 29 may be provided adjacent a center opening 17 for indicating a middle starting opening of the row.

Alternatively, the players may select letters located anywhere in a word and not only letters adjacent previously selected letters. Thus, the present game apparatus permits a playing of a further unique game not heretofore found in the art. Thus, in one specific form of playing the game, a plurality off players may be arranged in a circle with each successive player in a clockwise direction adding the next letter to the previously selected letters by suitable manipulation of the lettered strips. The object of the game would be to avoid completing a word of three letters or more with the person who loses being the one to start a new game for the next word. The apparatus may include a sufficient plurality of lettered strips to accommodate any word in the standard dictionary as desired. The center lettered strip is normally used to start the word of a new game. As indicated above, the next player adds a second letter to the word which, as further discussed above, may be contiguous to the right or to the left of the first selected letter or if so intended by the players, may be located anywhere in the word, i.e. spaced from the previous selected letter. The selected letters may be located anywhere in the word. Illustratively, the letter selected by the first player may be considered by the next player as being the last letter of a word so that the next player would select his letter somewhere to the left of the first selected letter. If the next player chooses that the first selected letter be the first selected letter of the word, he would then select a letter to the right of the first selected letter. If the next player decides that the first selected letter is in the middle of a word, the next player may then select a letter either to the left or to the right of the first selected letter.

The selection of letters continues in sequence by the players adding the letters one after another. The first player to complete a word of three letters or more loses the game. If a player adds a letter and the subsequent player believes that the letters as now appearing on the apparatus do not comprise a portion of a valid word, the subsequent player may challenge the player adding the last letter. If the challenged player cannot show that the previous letters, including his last added letter, are a portion of a valid word, the challenged player loses. If the challenged player can show that the letters are a part of a valid word, the challenger loses.

The challenge may be won on the basis that the previously selected letters do not correctly spell the word in the mind of the challenged player, and if necessary, reference to a dictionary may be made to establish the correctness of the spelling.

The rules may require that once a player selects a letter and passes the apparatus to the next player, he cannot change that letter. The rules may also require that the next player add the next letter within a preselected time, and if desired, a timer may be utilized in connection with the playing of the game. Illustratively, the scoring of the game may be such that each player in the game receives a point except the losing player and the first player to reach a preselected number of points, such as 21 points, wins the overall game.

Apparatus 10 may be formed of low cost material such as plastic, cardboard, etc. The game may be made quite small so as to fit in a player's pocket or purse, or may be made to be larger such as where used as a table game. Strips 12 may be suitably dimensioned to have a frictional fit in the slots so that the strips will remain in the adjusted position as in transferring the game from player to player, while yet the strips may be readily manipulated to the desired adjusted position by the players.

In the illustrated embodiment, the strips 12 are rectilinear elongated strips. Obviously, the carrier strips may comprise other forms of carriers, such as circular discs or annular elements. Thus, illustratively, the base may comprise a cylinder having a row of longitudinally related openings at diametrically opposite portions, and the carrier strips rotatably mounted within the cylinder to expose the selected letters at each of the opposite openings associated with each carrier. In such structure, the manipulating tabs may be brought out through suitable slits in the base for manipulating the annular carriers. Other arrangements of the apparatus will be obvious to those skilled in the art. However, the carrier elements are provided with an indicium, for indicating the disposition of the carrier in the starting arrangement, located accurately at the center of the alphabetical set of letters for minimum size and optimum facility of manipulation by the players in the playing of the game.

The apparatus may also be used as an educational device such as for teaching spelling. Simple sentences may be set out as desired for further educational use. Still further, the device may be used for teaching the alphabet; in such use, the apparatus may be provided with 26 lettered strips.

The foregoing disclosure of specific embodiments is illustrative of the broad inventive concepts comprehended by the invention.

I claim:

1. In an apparatus for playing word games including a base having a row of spaced openings, and a plurality of carriers manually adjustably mounted to said base associated one each with said openings, each carrier having an alphabetical set of letters identically disposed thereon to be exposed one at a time through the associated base opening whereby a group of selected letters may be viewed through said openings, the improvement comprising indicium means on each carrier at the mid-portion of the set of letters thereof for indicating that the associated carrier has not as yet been manipulated from a mid-portion to expose a selected letter in the playing of the game, said carriers defining opposite ends and each being provided at one end thereof with a selectively positionable manipulating portion hingedly connected to the carrier.

* * * * *